US010591119B2

(12) United States Patent
Kiefer

(10) Patent No.: US 10,591,119 B2
(45) Date of Patent: Mar. 17, 2020

(54) DECORATIVE FREE-STANDING ILLUMINATION TOWER FOR OUTDOOR AND AQUATIC ENVIRONMENTS

(71) Applicant: Raymond David Kiefer, Valley Forge, PA (US)

(72) Inventor: Raymond David Kiefer, Valley Forge, PA (US)

( * ) Notice: Subject to any disclaimer, the term of this patent is extended or adjusted under 35 U.S.C. 154(b) by 0 days.

(21) Appl. No.: 16/379,542

(22) Filed: Apr. 9, 2019

(65) Prior Publication Data

US 2019/0316744 A1 Oct. 17, 2019

Related U.S. Application Data

(60) Provisional application No. 62/658,846, filed on Apr. 17, 2018.

(51) Int. Cl.

| | |
|---|---|
| ***F21S 4/20*** | (2016.01) |
| ***F21S 6/00*** | (2006.01) |
| ***F21V 15/01*** | (2006.01) |
| ***F21V 31/00*** | (2006.01) |
| ***F21S 10/02*** | (2006.01) |
| *F21W 131/40* | (2006.01) |
| *F21Y 115/10* | (2016.01) |
| *F21S 9/02* | (2006.01) |

(52) U.S. Cl.

CPC ..... *F21S 4/20* (2016.01); *F21S 6/004* (2013.01); *F21S 10/02* (2013.01); *F21V 15/012* (2013.01); *F21V 31/005* (2013.01); *F21S 9/02* (2013.01); *F21W 2131/40* (2013.01); *F21Y 2115/10* (2016.08)

(58) Field of Classification Search

CPC .... F21S 4/20; F21S 6/004; F21S 10/02; F21S 9/02; F21V 15/012; F21V 31/005; F21Y 2115/10; F21W 2131/40

USPC ..... 362/84

See application file for complete search history.

(56) References Cited

U.S. PATENT DOCUMENTS

| | | | | |
|---|---|---|---|---|
| 5,005,309 | A * | 4/1991 | Hall | A01K 61/70 43/4 |
| 2004/0056779 | A1* | 3/2004 | Rast | B63B 22/16 340/985 |
| 2017/0038047 | A1* | 2/2017 | Golle | F21K 9/90 |

* cited by examiner

*Primary Examiner* — Anh T Mai
*Assistant Examiner* — Hana S Featherly

(57) ABSTRACT

A decorative free-standing illumination tower for outdoor and aquatic environments is capable of being deployed in outdoors and aquatic environments without the need of an external support. The tower includes an elongated tube, a plurality of lighting fixtures, a light controller, a power source, a first endcap, and a second endcap. The plurality of lighting fixtures is mounted in a helical fashion around the elongated tube. Consequently, the plurality of lighting fixtures is positioned along a longitudinal axis and radially mounted around the elongated tube. The first endcap and the second endcap connect at opposite ends of the elongated tube. The light controller is an electronic device that controls the actuation of the plurality of lighting fixtures. Accordingly, the plurality of lighting fixtures can be made to display various patterns, images, and colors. Finally, the power source provides electrical power to the plurality of lighting fixtures and the light controller.

12 Claims, 9 Drawing Sheets

DECORATIVE FREE-STANDING ILLUMINATION TOWER FOR OUTDOOR AND AQUATIC ENVIRONMENTS

The current application claims a priority to the U.S. Provisional Patent application Ser. No. 62/658,846 filed on Apr. 17, 2018.

FIELD OF THE INVENTION

The present invention generally relates to a decorative free-standing illumination tower for outdoor and aquatic environments. More specifically, the present invention enables a plurality of lighting fixtures to be deployed in outdoors and aquatic environments without the need for an external support structure.

BACKGROUND OF THE INVENTION

There is a large market for decorative fixtures expressing festive and celebratory moods for and during different occasions. In particular, the use of string lights and the like to provide decorative illumination to celebrate various occasions, such as Christmas or a wedding, is a common practice. People also use string lights to enhance the aesthetics of the environment they wish to improve, such as, for example: an outdoor-styled restaurant. However, employing string lights can present several problems that greatly limit their user and effectiveness. Firstly, string lights have a tendency to be tangled up when being stowed away during disuse. This can be frustrating for the user who has must untangle the string lights in order to use them. Also, it can be a hazard to the user if, during the untangling process, the string lights were to be damaged. This can cause electric shocks if the damage is not caught prior to the string lights being plugged into a power source. Secondly, installing the string lights can be frustrating and dangerous. The only means of installing string lights is to hang them or attach them to pre-existing, permanent structure, such as a building or a tree. However, not every environment has trees or other similarly tall/large structures to attach or hang string lights from; such as, for example, a parade float or a vehicle. Also, if a user wanted to have a decorative illumination device indoors, the user would have difficulty in finding an efficient means of hanging or attaching the string lights indoors without the string lights interfering with other people.

An objective of the present invention is to provide users with a free-standing illumination device that can be mounted outdoors or underwater environments without the need for an external support. The present invention is a free-standing illumination device that can be utilized in a wide variety of environmental conditions, from outdoor environments to underwater environments. An objective of the present invention is to provide a free-standing illumination device that gives the impression of vertically "floating lights" to the onlookers. The present invention intends to provide users with a decorative illumination device that will be easier to store and/or transport, while preventing entanglement of the string lights or damages to the string lights when deploying the present invention. Further, another objective of the present invention is to provide users with a method for preparing the illumination device for installation at a desired location.

DETAILED DESCRIPTION OF THE INVENTION

All illustrations of the drawings are for the purpose of describing selected versions of the present invention and are not intended to limit the scope of the present invention.

Figure 1:
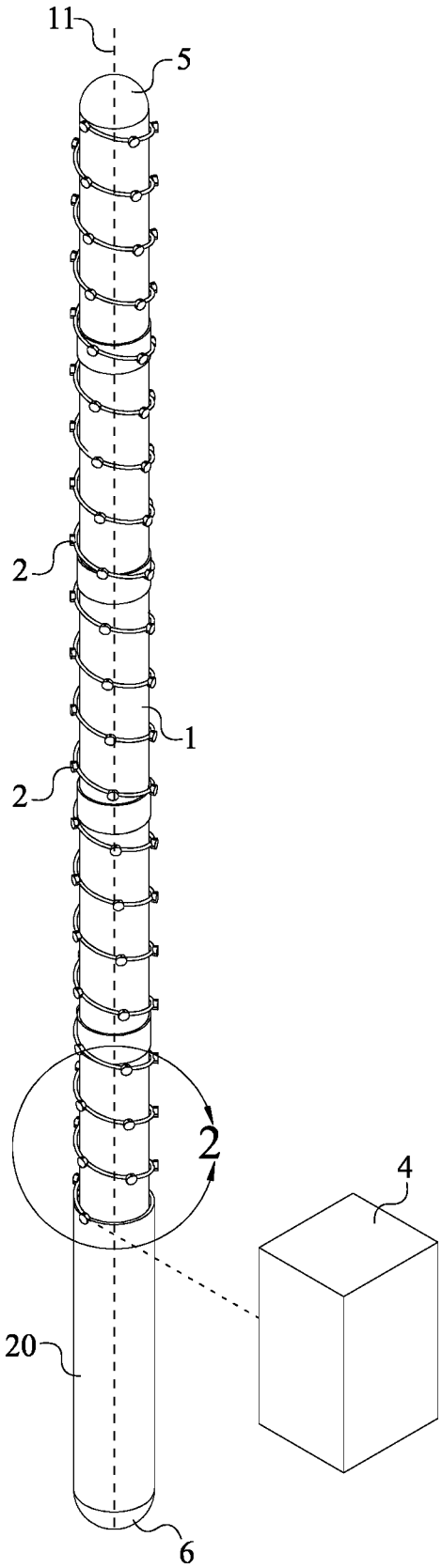
FIG. 1 is a top perspective view of the present invention.
Figure 2:
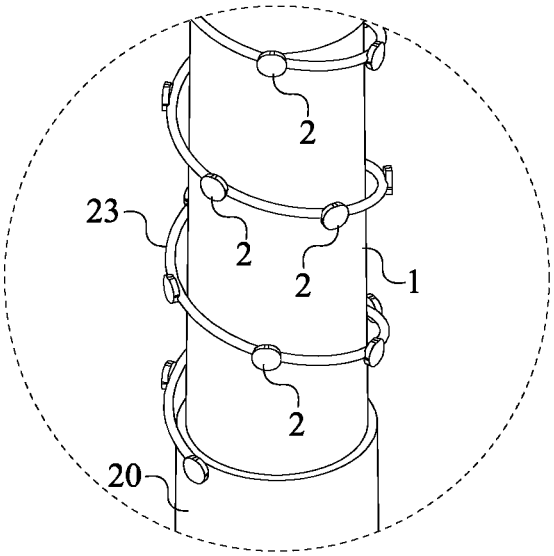
FIG. 2 is a detail view of section 2 in FIG. 1 showing the plurality of lighting fixtures connected by the power cord.

The present invention is a decorative free-standing illumination tower for outdoor and aquatic environments. The preferred embodiment of the present invention comprises an elongated tube 1, a plurality of lighting fixtures 2, a power source 4, a first endcap 5, and a second endcap 6. As can be seen in FIG. 1, the elongated tube 1 is a slender free-standing tube that can stand without external supports. In the preferred implementation, the elongated tube 1 is partially buried in the ground. Alternately, the elongated tube 1 may be mounted in an urn 8 for structural support. Further, in another possible embodiment, the elongated tube 1 may be tapered. This allows the elongated tube 1 to be mounted outdoors or underwater with minimal structural support. The preferred embodiment of the elongated tube 1 is made of organic plant materials. In one possible embodiment, the elongated tube 1 may be a bamboo culm 14. Alternately, the elongated tube 1 may be made of high-density polyvinyl chloride (PVC). In all cases, it is preferred that the pillar be made of a material that is durable, strong, rigid, weather-resistant, water-proof, shock-proof, inflammable, light-weight, modular, non-toxic, environmentally friendly, easily manufacturable, impact-resistant, and/or shatter-proof. Further, in a possible embodiment of the present invention, the elongated tube 1 may comprise a plurality of detachable sections 12. The plurality of detachable sections 12 enables the elongated tube 1 to be dismantled for ease of transportation and storage. The preferred embodiment of the plurality of lighting fixtures 2 is a light emitting diode (LED) connected by a power cord 23, as can be seen in FIG. 2. Alternately, the plurality of lighting fixtures 2 may be a mini LED, micro LED, miniature incandescent lightbulbs, or a similar lighting device known in the relevant arts. The power cord 23 provides electricity to the plurality of lighting fixtures 2. Further, the power cord 23 also structurally supports the plurality of lighting fixtures 2 in the desired position. The plurality of lighting fixtures 2 may be multi-colored or a single color depending on the visual design desired by the user.

The plurality of lighting fixtures 2 is mounted around the elongated tube 1 in a helical configuration. In particular, the plurality of lighting fixtures 2 is positioned along a longitudinal axis 11 of the elongated tube 1. Further, the plurality of lighting fixtures 2 is also radially mounted around the elongated tube 1. This provides illumination to the elongated tube 1 and creates an aesthetically pleasing design. The first endcap 5 and the second endcap 6 seal the ends of the elongated tube 1 and protect the users from cutting themselves on the sharp edges of the elongated tube 1. As such, the first endcap 5 is terminally connected to the elongated tube 1. Similarly, the second endcap 6 is terminally connected to the elongated tube 1, opposite the first endcap 5. The plurality of lighting fixtures 2 is powered by the power source 4. As such, the power source 4 is electrically connected to the plurality of lighting fixtures 2. The preferred power source 4 is a rechargeable battery positioned external to the elongated tube 1. Alternately, the power source 4 may be an electrical wall-outlet.

Figure 9:
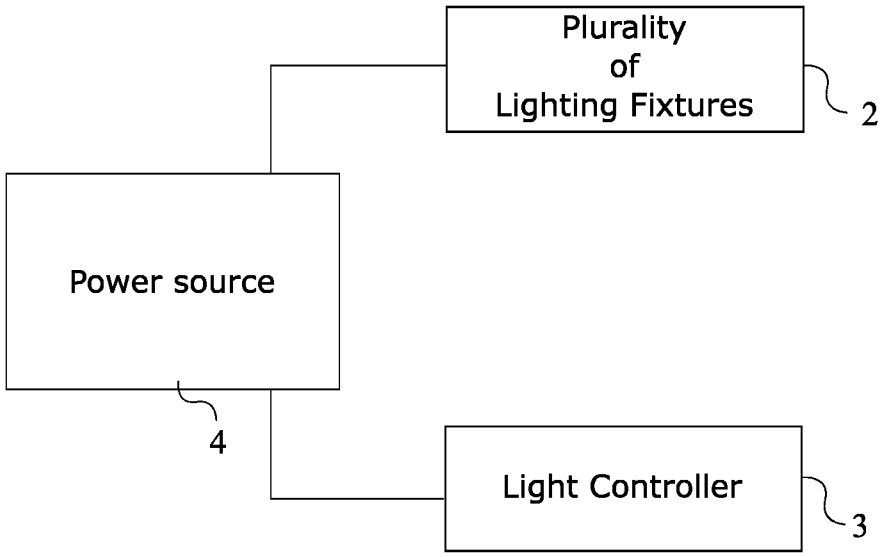
FIG. 9 is a schematic of the electrical connections between the power source, the light controller, and the plurality of lighting fixtures.

Referring to FIG. 9, a light controller 3 controls the actuation of the plurality of lighting fixtures 2. More specifically, the light controller 3 controls the intensity, color, duration, power state, and rhythm, pattern, or pulse of the plurality of lighting fixtures 2. In the preferred implementation, the light controller 3 activates the plurality of lighting fixtures 2 in a manner which creates various patterns and images on the elongated tube 1. Accordingly, the light controller 3 is electronically connected to the plurality of lighting fixtures 2. Further, the power source 4 is electrically connected to the light controller 3.

Figure 3:
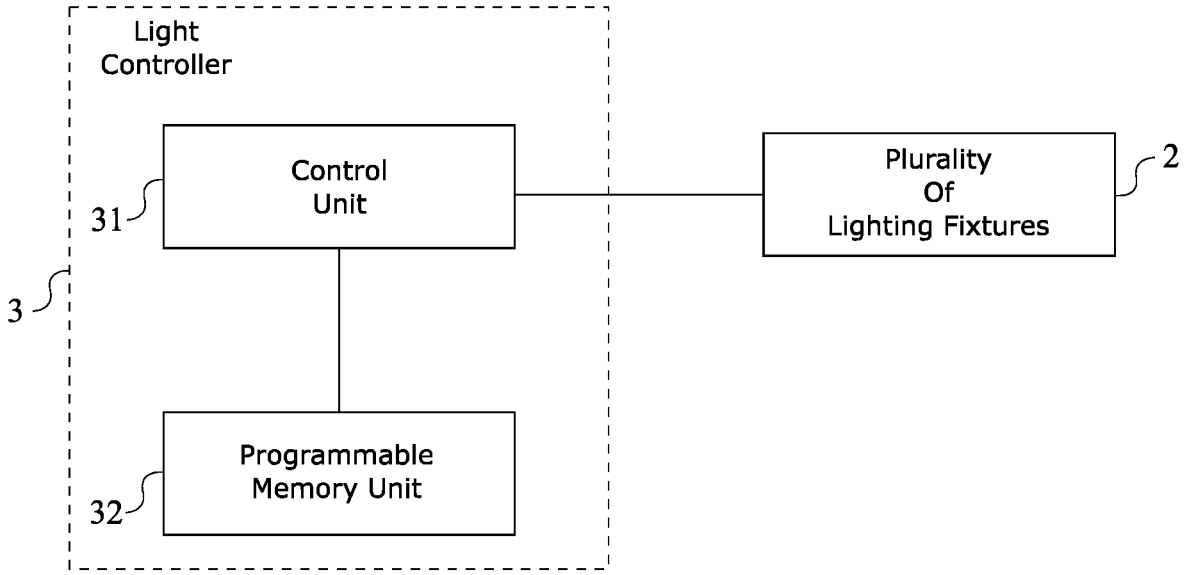
FIG. 3 is a schematic of the electronic connection between the programmable-memory unit, the control unit, and the plurality of lighting fixtures.

Referring to FIG. 3, the preferred embodiment of the light controller 3 comprises a control unit 31 and a programmable-memory unit 32. The control unit 31 and the programmable-memory unit 32 may be housed in a protective enclosure. The protective enclosure may include, but is not limited to, switches, dials, buttons, sensors, resistors, knobs, a screen or user interface, and the like to allow a user to operate the control unit 31. The control unit 31 is an integrated circuit that controls the actuation of the plurality of lighting fixtures 2. The control unit 31 is electronically connected to the programmable-memory unit 32. Preferably, the programmable-memory unit 32 stores programs to be executed by the control unit 31. Further, the control unit 31 is electronically connected to the plurality of lighting fixtures 2. As such the control unit 31 causes the plurality of lighting fixtures 2 to display patterns and colors for an aesthetically pleasing design. In possible embodiments of the present invention, the light controller 3 may be controlled by a remote control. The remote control allows the user to remotely alter the parameters of the plurality of lighting fixtures 2 without having to physically access the light controller 3, which can be unfeasible to do depending on desired location of the device when installed.

Figure 4:
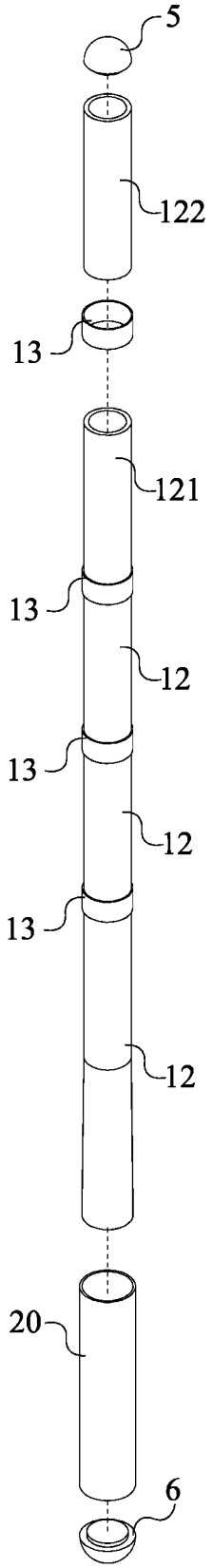
FIG. 4 is an exploded view of the elongated tube showing the plurality of detachable sections.

Referring to FIG. 4, in the preferred embodiment of the present invention, the elongated tube 1 comprises the plurality of detachable sections 12. Preferably, the plurality of detachable sections 12 is a part of the bamboo culm 14 that has been cut into a small size. The plurality of detachable sections 12 is configured into the elongated tube 1. As such, an arbitrary detachable section 121 from the plurality of detachable sections 12 is attached to an adjacent detachable section 122 from the plurality of detachable sections 12 by a connecting ring 13. In the preferred embodiment, the arbitrary detachable section 121 may be glued to the adjacent detachable section 122. The connecting ring 13 is positioned concentric to the arbitrary detachable section 121 and the adjacent detachable section 122.

Referring back to FIG. 2, the power cord 23 allows the plurality of lighting fixtures 2 to be connected to the power source 4 or alternately to the wall-outlet. As such, the light controller 3 is electrically connected to the plurality of lighting fixtures 2 by the power cord 23. Further, the power cord 23 also provides structural support for the plurality of lighting fixtures 2. As such, the plurality of lighting fixtures 2 is connected to each other by the power cord 23. To form the desired helical configuration, the power cord 23 is wound around the elongated tube 1. Once the desired helical configuration is achieved, the power cord 23 is attached to the elongated tube 1 with zip ties.

Figure 5:
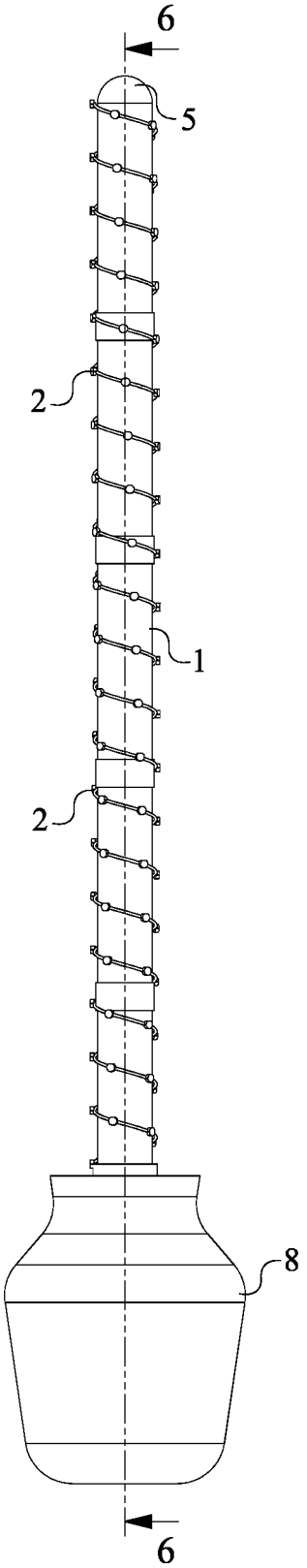
FIG. 5 is a side view of the elongated tube mounted inside an urn.

Referring to FIG. 4 and FIG. 5, as mentioned before, the elongated tube 1 is the bamboo culm 14. To prepare the bamboo culm 14, branches are removed from the nodes of the bamboo culm 14. The bamboo culm 14 is then cut into the desired length. In the preferred embodiment, the bamboo culm 14 is also sectioned at the nodes to create the plurality of detachable sections 12. Once prepared, the bamboo culm 14 may be buried in the ground or mounted to the urn 8 for structural support. As such, the bamboo culm 14 comprises an exposed portion 15 and a submerged portion 16. The submerged portion 16 is buried in the ground or contained within the urn 8. The exposed portion 15 is left exposed over the ground. The plurality of lighting fixtures 2 is mounted around the exposed portion 15. As such, the submerged portion 16 is adjacently positioned to the exposed portion 15.

Figure 6:
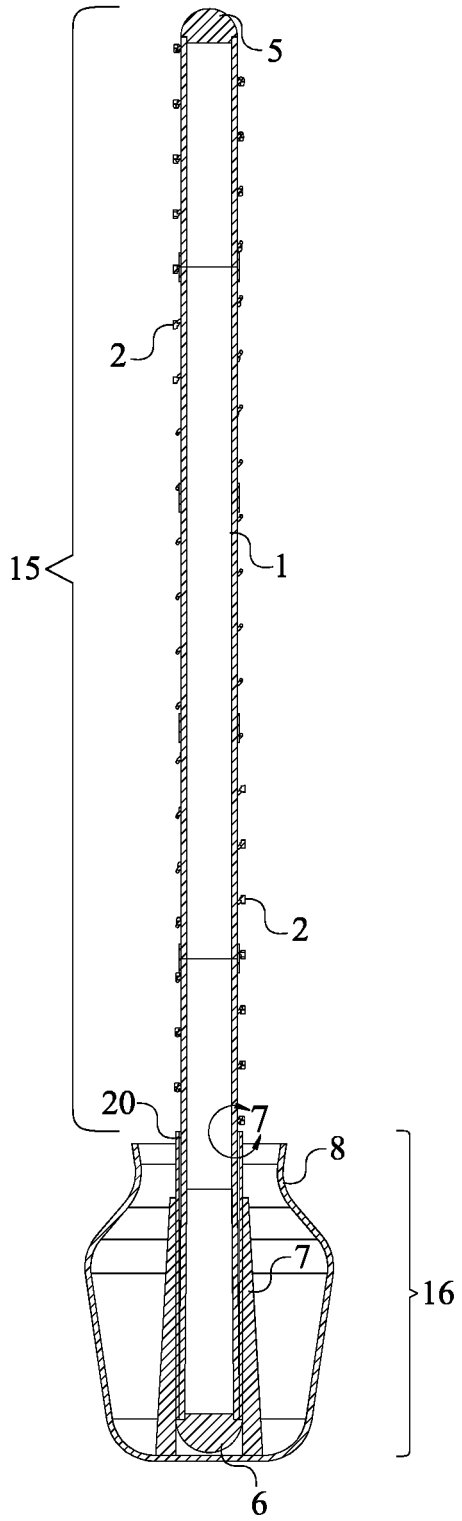
FIG. 6 is a cross-section view taken along line 6-6 in FIG. 5 showing the elongated tube mounted within a ground anchor.
Figure 7:
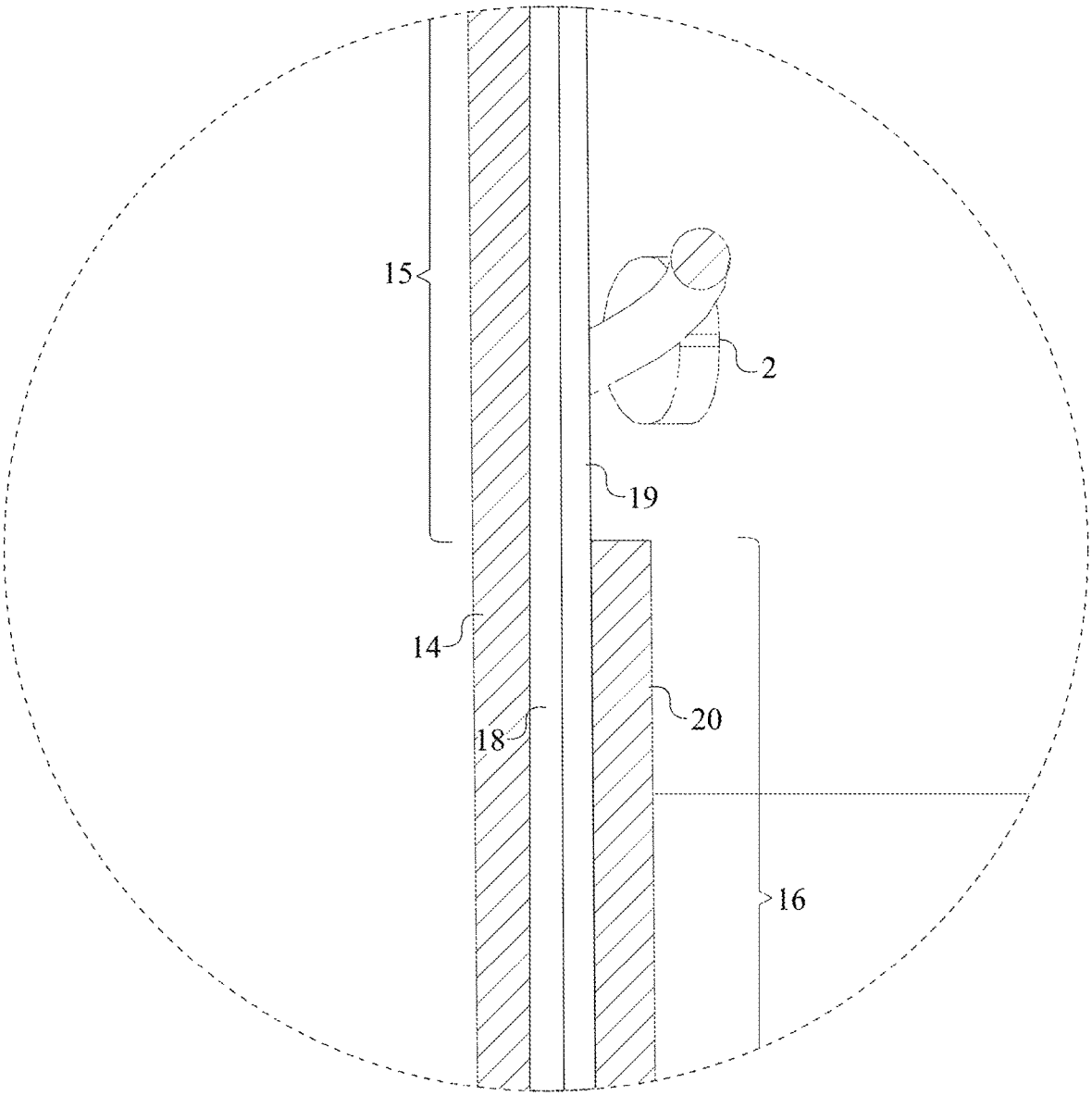
FIG. 7 is a detail view of section 7 in FIG. 6 showing the chemical compound and the paint mixture coated over the elongated tube.

Referring to FIG. 6 and FIG. 7, before applying the chemical compound, the surface of the bamboo culm 14 is sanded to create a smooth outer surface and remove any splinters. To achieve this, the bamboo culm 14 is dried at approximately between 70° F. and 80° F., or at around 75° F., until the bamboo culm 14 has met at least a relative humidity between 10% and 20%, or at around 15% relative humidity. Subsequently, the bamboo culm 14 is sanded or sand-blasted to a desired smoothness. The next step requires that removal of all excess dust and related particles from the surfaces of the bamboo culm 14. The outer surface of the bamboo culm 14 is then coated with a chemical compound to create a smooth finish. To achieve this, the exposed portion 15 and the submerged portion 16 are superimposed with a chemical compound solution 18. The chemical compound solution 18 is then superimposed on the bamboo culm 14. In the preferred embodiment, the outer surface of the elongated tube 1 is painted in an aesthetically pleasing color. Accordingly, a paint mixture 19 is superimposed over the chemical compound solution 18. A rubberized sealant 20 is provided to protect the paint mixture 19 and coated over the submerged portion 16. As such, the rubberized sealant 20 is superimposed over the paint mixture 19. Further, the submerged portion 16 is covered by the rubberized sealant 20. This protects the paint mixture 19 from dirt and debris contained in the ground.

In the preferred embodiment of the present invention, the chemical compound solution 18 comprises acetone, lacquer thinner, trisodium phosphate, and saltwater. More specifically, the chemical compound solution 18 is a mixture with the combination of 45% to 55% acetone, 20% to 30% lacquer thinner, 20% to 30% trisodium phosphate, and approximately 1% to 5% saltwater.

Figure 8:
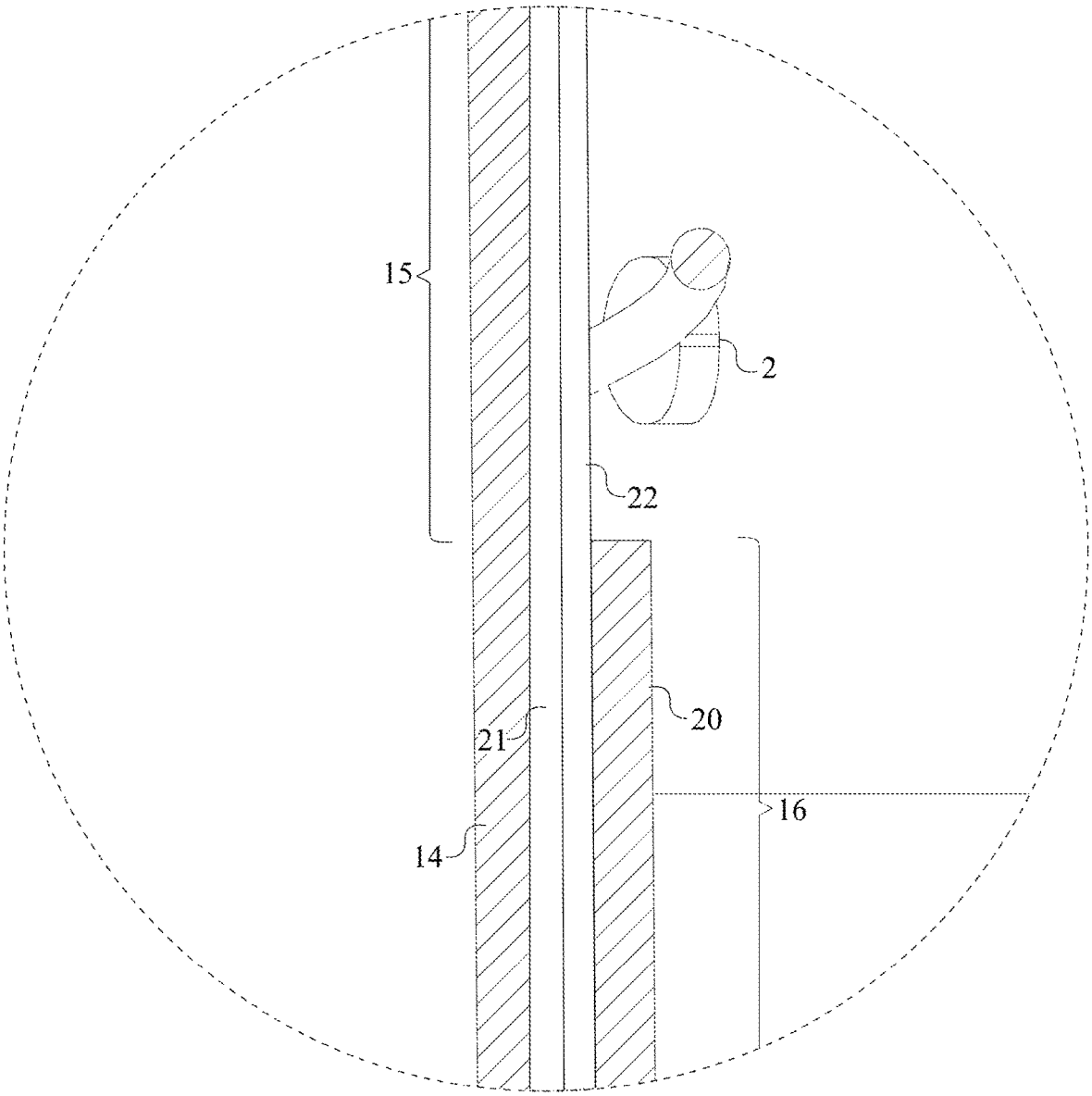
FIG. 8 is a detail view of section 7 in FIG. 6 showing the wood stain and the protective mixture coated over the elongated tube.

Referring to FIG. 6 and FIG. 8, in another possible embodiment of the present invention, the outer surface of the bamboo culm 14 is coated with a wood stain solution 21. As such, the bamboo culm 14 is superimposed with the wood stain solution 21. This embodiment requires coating the wood stain solution 21 with a protectant. As such, a protective mixture 22 is superimposed over the wood stain solution 21. The protectant mixture may be a spar urethan or a similar protectant. To protect the wood stain solution 21 while submerged in the ground, the rubberized sealant 20 is superimposed over the wood stain solution 21. More specifically, the submerged portion 16 is covered by the rubberized sealant 20.

In yet another embodiment of the present invention, the elongated tube 1 is made of a polymeric material. More specifically, the elongated tube 1 is made of PVC. Alternately, the elongated tube 1 may be made of materials including, but not limited to, wood, metal, other plastics, and other similar materials.

Referring to FIG. 6, in a possible embodiment, a ground anchor 7 enables the elongated tube 1 to stand freely without being submerged in the ground. More specifically, the ground anchor 7 allows the elongated tube 1 to stand freely without the aid of external supports, especially if the height of the elongated tube 1 is very high. As such, the ground anchor 7 is attached over the submerged portion 16 of the elongated tube 1. The preferred ground anchor 7 is a hollow cylindrical tube attached around the submerged portion 16 of the elongated tube 1. Also, it is preferred that the ground anchor 7 be of an outer diameter and of a height sufficient enough to the keep the elongated tube 1 in an upright position without fear of the elongated tube 1 toppling over or falling down; however, it is preferred that the ground anchor 7 be of an inner diameter similar to the outer diameter of the bottom end/section of the elongated tube 1.

Referring once again to FIG. 6, in another possible embodiment, the elongated tube 1 may be mounted in the urn 8. The preferred urn 8 is a rounded vase with a flat bottom allowing the urn 8 to stand while unsupported. The urn 8 is preferably made of ceramics for a pleasing visual design. Alternately, the urn 8 may be made of metals, plastics, wood, or any such material known in the relevant arts. In the preferred implementation, the elongated tube 1 is supported by the ground anchor 7 in the urn 8. As such, the ground anchor 7 is connected within the urn 8. More specifically, the ground anchor 7 is engaged in the center of the urn 8 for inserting in the elongated tube 1. Accordingly, the ground anchor 7 is mounted into the submerged portion 16 of the elongated tube 1. This connects the elongated tube 1 to the urn 8. Preferably, the urn 8 contains a single ground anchor 7. In alternate embodiments, the urn 8 may contain a plurality of ground anchors for inserting in a plurality of elongated tubes.

Although the invention has been explained in relation to its preferred embodiment, it is to be understood that many other possible modifications and variations can be made without departing from the spirit and scope of the invention as hereinafter claimed.

What is claimed is:

1. A decorative free-standing illumination tower for outdoor and aquatic environments comprising:
- an elongated tube;
- a plurality of lighting fixtures;
- a power source;
- a first endcap;
- a second endcap;
- the plurality of lighting fixtures being positioned along a longitudinal axis of the elongated tube;
- the plurality of lighting fixtures being radially mounted around the elongated tube;
- the first endcap being terminally connected to the elongated tube;
- the second endcap being terminally connected to the elongated tube;
- the second endcap being oppositely located to the first endcap;
- the power source being electrically connected to the plurality of lighting fixtures;
- the elongated tube comprising a plurality of detachable sections and a plurality of connecting rings;
- the plurality of detachable sections and the plurality of connecting rings being positioned concentric to each other; and
- an arbitrary detachable section among the plurality of detachable sections being attached to an adjacent detachable section among the plurality of detachable sections by a corresponding connecting ring among the plurality of connecting rings.

2. The decorative free-standing illumination tower for outdoor and aquatic environments as claimed in claim 1 comprising:
- a light controller;
- the light controller being electronically connected to the plurality of lighting fixtures; and
- the power source being electrically connected to the light controller.

3. The decorative free-standing illumination tower for outdoor and aquatic environments as claimed in claim 2 comprising:
- the light controller comprising a control unit and a programmable-memory unit;
- the control unit being electronically connected to the programmable-memory unit; and
- the control unit being electronically connected to the plurality of lighting fixtures.

4. The decorative free-standing illumination tower for outdoor and aquatic environments as claimed in claim 1 comprising:
- the power source being externally positioned to the elongated tube.

5. The decorative free-standing illumination tower for outdoor and aquatic environments as claimed in claim 1 comprising:
- a power cord;
- the plurality of lighting fixtures being connected to each other by the power cord;
- the power cord being wound around the elongated tube; and
- the light controller being electrically connected to the plurality of lighting fixtures by the power cord.

6. The decorative free-standing illumination tower for outdoor and aquatic environments as claimed in claim 1 comprising:
- the elongated tube being a bamboo culm;
- the bamboo culm comprising an exposed portion and a submerged portion; and
- the submerged portion being adjacently positioned to the exposed portion.

7. The decorative free-standing illumination tower for outdoor and aquatic environments as claimed in claim 6 comprising:
- the exposed portion and the submerged portion being superimposed with a chemical compound solution;
- a paint mixture being superimposed over the chemical compound solution;
- a rubberized sealant being superimposed over the paint mixture; and
- the submerged portion being covered by the rubberized sealant.

8. The decorative free-standing illumination tower for outdoor and aquatic environments as claimed in claim 7 comprising:

the chemical compound solution comprising acetone, lacquer thinner, trisodium phosphate, and saltwater.

9. The decorative free-standing illumination tower for outdoor and aquatic environments as claimed in claim 1 comprising:

the elongated tube being a bamboo culm;

the bamboo culm being superimposed with a wood stain solution;

a protective mixture being superimposed over the wood stain solution;

a rubberized sealant being superimposed over the wood stain solution; and a submerged portion being covered by the rubberized sealant.

10. The decorative free-standing illumination tower for outdoor and aquatic environments as claimed in claim 1, wherein the elongated tube is made of a polymeric material.

11. The decorative free-standing illumination tower for outdoor and aquatic environments as claimed in claim 1 comprising:

a ground anchor; and the ground anchor being attached over a submerged portion of the elongated tube.

12. The decorative free-standing illumination tower for outdoor and aquatic environments as claimed in claim 11 comprising:

an urn; and the ground anchor being connected within the urn; and the ground anchor being mounted into the submerged portion of the elongated tube.

* * * * *